US007152341B2

(12) United States Patent
Dean

(10) Patent No.: US 7,152,341 B2
(45) Date of Patent: Dec. 26, 2006

(54) FOOTWEAR HAVING A HEEL AND HEEL BREAST

(75) Inventor: Norman Dean, Pleasant Valley, NY (US)

(73) Assignee: Nine West Development Corporation, Wilmington, DE (US)

( * ) Notice: Subject to any disclaimer, the term of this patent is extended or adjusted under 35 U.S.C. 154(b) by 280 days.

(21) Appl. No.: 10/858,319

(22) Filed: Jun. 1, 2004

(65) Prior Publication Data

US 2005/0262733 A1 Dec. 1, 2005

(51) Int. Cl.
*A43B 13/40* (2006.01)

(52) U.S. Cl. ..... 36/24.5; 36/28; 36/35 R; 36/76 C

(58) Field of Classification Search ..... 36/24.5, 36/25 R, 28, 34 R, 37, 35 R, 76 C, 107, 36/108

See application file for complete search history.

(56) References Cited

U.S. PATENT DOCUMENTS

| | | | | |
|---|---|---|---|---|
| 166,621 | A | 8/1875 | Meyer et al. | |
| 293,359 | A | 2/1884 | Rollhaus | |
| 325,730 | A | 9/1885 | Castle | |
| 350,539 | A | 10/1886 | Le Gay | |
| 1,113,486 | A | 10/1914 | Richardson et al. | |
| 1,842,017 | A | 1/1932 | Gabriel | |
| 1,925,218 | A | 9/1933 | Webster | |
| 1,934,092 | A | 11/1933 | Rigante | |
| 1,968,047 | A | 7/1934 | Lovejoy | |
| 1,995,831 | A * | 3/1935 | Baynard | 36/37 |
| D95,053 | S | 4/1935 | Lovejoy | |
| 2,093,354 | A | 9/1937 | Grinde | |
| 2,119,363 | A * | 5/1938 | Slosberg | 36/24.5 |
| 2,121,172 | A | 6/1938 | Lovejoy | |
| 2,133,352 | A | 10/1938 | Jannings | |
| 2,165,427 | A | 7/1939 | Vigorith et al. | |
| D121,671 | S | 7/1940 | Cocozella | |
| 2,299,840 | A | 10/1942 | Merritt | |
| 2,648,144 | A | 8/1953 | Stein | |
| 3,025,616 | A | 3/1962 | Joiner | |
| D194,204 | S | 12/1962 | Taicher et al. | |
| 3,099,096 | A | 7/1963 | Fabian | |
| 3,153,865 | A * | 10/1964 | Steinbock | 36/24.5 |
| 4,404,757 | A * | 9/1983 | Sweeny | 36/107 |
| 4,439,937 | A * | 4/1984 | Daswick | 36/107 |
| 4,835,884 | A | 6/1989 | Bianchini et al. | |
| 4,876,805 | A | 10/1989 | Peoples | |
| 5,488,699 | A | 1/1996 | Hanson, Jr. | |
| 6,101,743 | A * | 8/2000 | Brown | 36/102 |
| 6,519,874 | B1 | 2/2003 | Dean | |

* cited by examiner

*Primary Examiner*—Marie Patterson
(74) *Attorney, Agent, or Firm*—Senniger Powers

(57) ABSTRACT

Footwear including an outsole, an insole having a heel pad located at a heel portion of the insole and a heel having a cavity sized and shaped for receiving the heel pad. A heel breast projects forward from the heel and is sized and shaped for receiving a portion of the heel pad extending forward from the heel cavity.

20 Claims, 9 Drawing Sheets

FOOTWEAR HAVING A HEEL AND HEEL BREAST

BACKGROUND OF THE INVENTION

This invention relates generally to footwear, and in particular to footwear having a heel and heel breast collectively adapted for receiving a heel pad for cushioning a foot inside the footwear.

During each step ("a gait cycle"), the heel generally strikes the ground first, and the foot pivots on the heel so the lateral part of the forefoot contacts the ground. The foot then rapidly rotates so the medial part of the forefoot contacts the ground. At this point, the foot is in a neutral position in which the bottom of the calcaneus (i.e., the heel bone) and the metatarsal heads (i.e., the bones forming the ball of the foot) are supported by the ground. The foot then rolls upward on the metatarsal heads before the distal and proximal phalanges (i.e., the toe bones) flex downward to push off the ground in preparation of the next step.

As description above, certain parts of the foot are subjected to impact forces which are transferred to other skeletal structures such as the shins and knees when walking. Preferably, footwear attenuates these impact forces to reduce stresses to the wearer's body. One common approach for attenuating the impact forces to a wearer is to provide additional padding, such as a heel pad, in the sole for underlying the wearer's heel. Typically, an upper portion of the heel surface has a recessed portion to receive the heel pad and accommodate the additional padding. It is important that the recessed portion of the heel and accordingly, the padding be positioned beneath the location on the wearer's foot to which the impact force is applied. In a heeled shoe, such as a woman's pump, the impact location on the wearer's foot is commonly forward of the heel of the shoe. In fact, the heel impact location moves more forward (i.e., toward the toe) as the height of the heel increases. As a result, the padding does not lie directly beneath the impacted portion and therefore, does not effectively attenuate the impact forces. Accordingly, there is a need for a heeled shoe having padding underlying the stressed portion of a wearer's foot.

SUMMARY OF THE INVENTION

In one aspect, footwear of the present invention comprises an outsole, a heel, an insole, and a heel pad located at a heel portion of the insole. A heel breast, which projects forward from the heel, is sized and shaped for receiving at least a portion of the heel pad extending forward from the heel cavity.

In another aspect of the present invention, a shoe comprises an upper shaped to define a volume for receiving a foot therein and having an opening for passage of the foot into the volume and a sole. The sole comprises an outsole, a heel, an insole, and a heel pad located at a heel portion of the insole. The heel further includes a heel breast projecting forward from the heel. The heel breast is sized and shaped for receiving at least a portion of the heel pad extending forward from the heel cavity.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
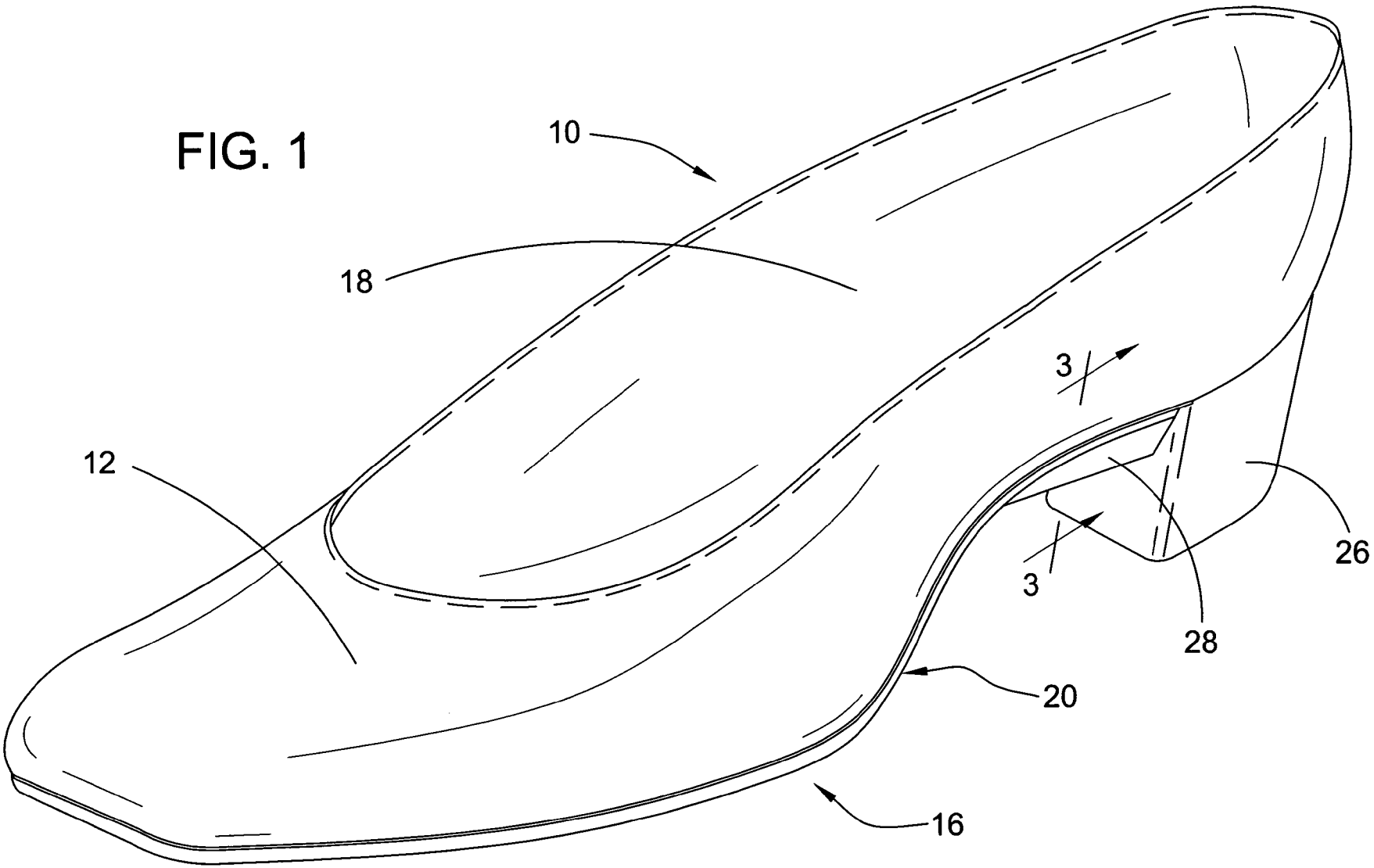
FIG. 1 is a perspective of a woman's pump having a heel and a heel breast.

Referring now to the drawings, and more particularly to FIG. 1, footwear of the present invention is designated in its entirety by the reference numeral 10. Although a woman's pump is shown and described with respect to the illustrated embodiment, those skilled in the art will appreciate that the present invention may be employed in other types of heeled footwear for women and men. Corresponding application by Duane Peoples, entitled FOOTWEAR COMFORT COMPONENTRY, Ser. No. 10/858,105, filed simultaneously herewith is incorporated by reference.

The pump 10 generally includes a conventional upper 12, and a sole, generally designated by 16. The upper 12 is attached to the sole 16 using techniques know in the art, such as glueing and/or sewing. The upper 12 is shaped to define a volume for receiving a foot therein and has an opening 18 for passage of the foot into the volume. The upper 12 may be made of calf leather or other material (including other synthetic and natural materials) conventionally used in uppers and may be lined or unlined. Because the construction of the upper 12 is conventional and well known in the art, it will not be described in further detail. Moreover, the illustrated upper may have other configurations that illustrated herein. For example, if footwear is a sandal (not shown), the upper typically is formed of several, spaced apart pieces.

Figure 2:
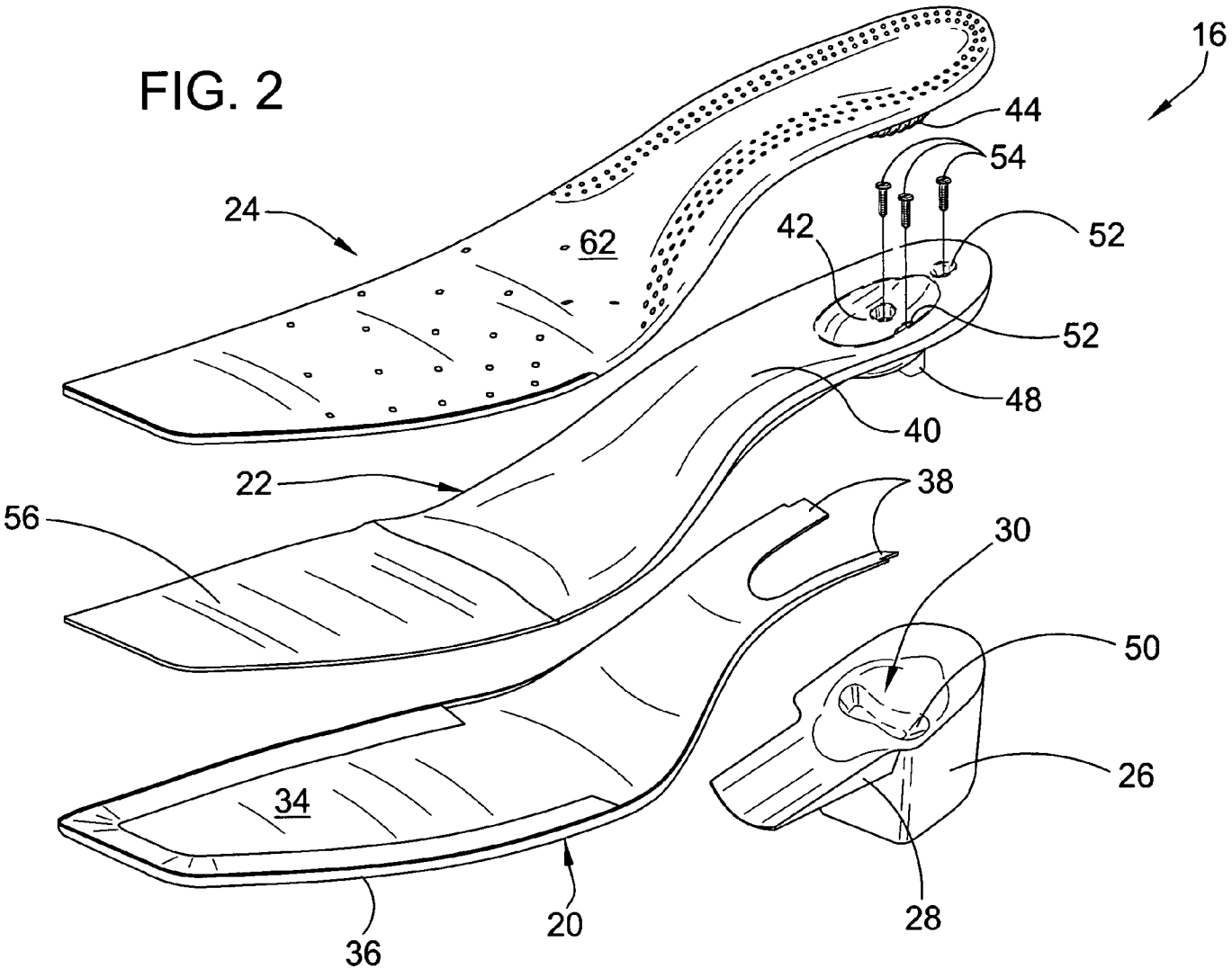
FIG. 2 is an exploded perspective of a sole of the pump from a vantage slightly above the sole.
Figure 3:
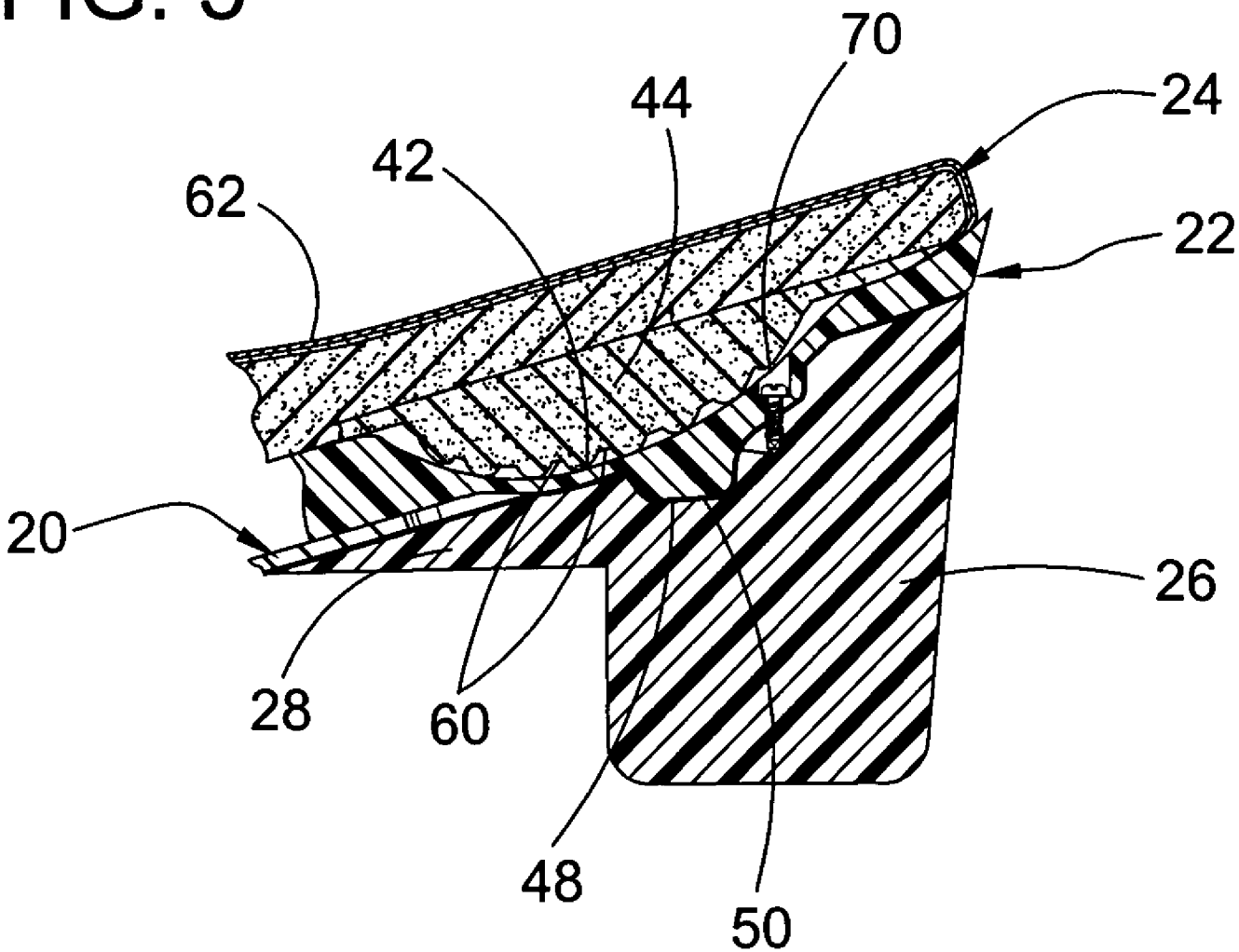
FIG. 3 is a fragmentary section taken in the plane along line 3—3 of FIG. 1.
Figure 4:
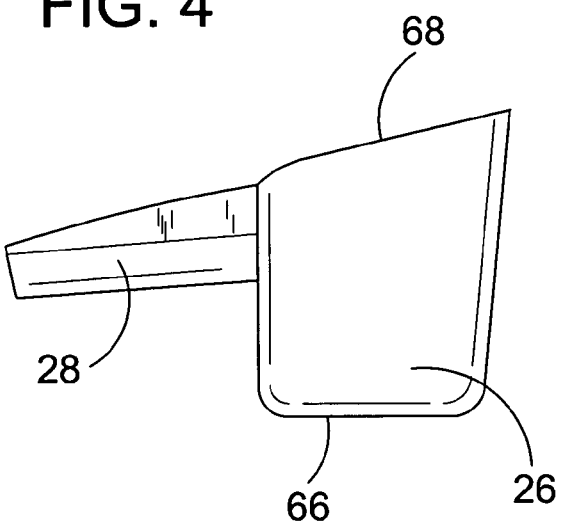
FIG. 4 is a side elevation of the heel of the pump and heel breast.
Figure 5:
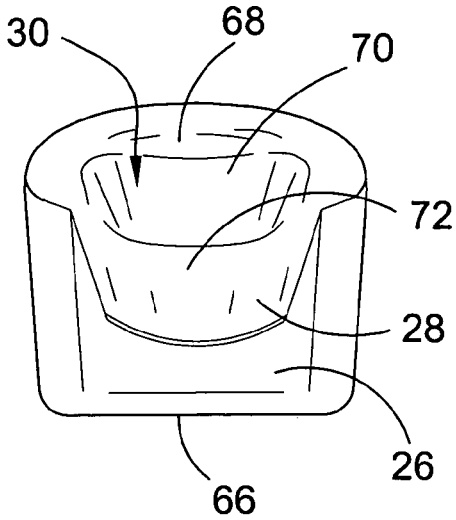
FIG. 5 is a front elevation of the heel and heel breast.
Figure 6:
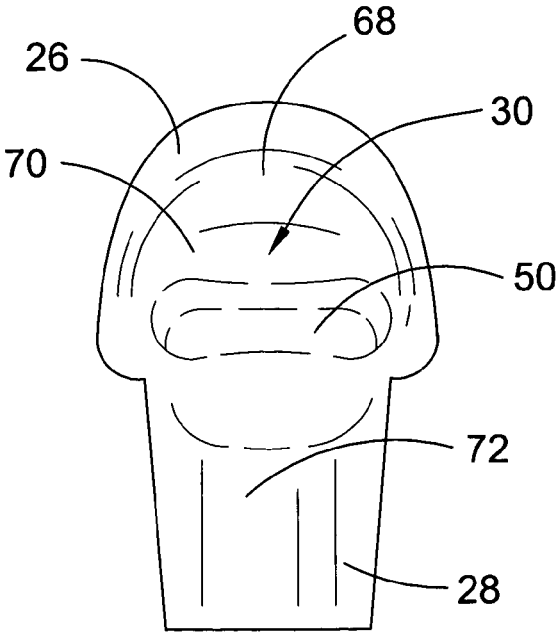
FIG. 6 is a top plan view of the heel and heel breast.
Figure 7:
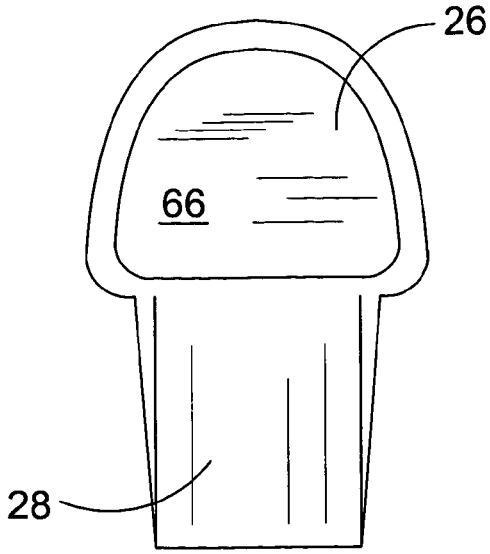
FIG. 7 is a bottom plan view of the heel and heel breast.

As illustrated in FIGS. 2 and 3, the sole 16 generally comprises an outer sole (or outsole, generally designated by 20), an inner sole (or insole, generally designated by 22), an insole cushion (generally designated by 24), a heel 26, and a heel breast 28. The heel 26 and heel breast 28 collectively form a common recess, generally indicated at 30, for receiving a padded portion of the insole 22. The heel 26 and heel breast 28 are described in further detail below.

The outsole 20 has a top surface 34 and a bottom surface 36 opposite the top surface forming a bottom of the pump 10. The bottom surface 36 may have a tread (not shown) to increase traction with the ground. The outsole 20 further comprises two rearwardly extending heel engaging tabs 38 for affixing the outsole to the heel 26. The outsole 20 may be made of any suitable outsole material such as leather, PVC, polyurethane, TPR, rubber or a combination thereof. Although the construction of the outsole of one embodiment is described above, it is envisioned that the outsole may have other constructions without departing from the scope of the present invention.

As further illustrated in FIGS. 2 and 3, the insole 22 is positioned above the outsole 20. Adhesive is used to bond the outsole 20 and insole 22 together. However, other forms of connecting the outsole and insole may be employed. A piece of fabric (not shown) may be attached to the underside of the insole 22 (e.g., during formation of the insole). The fabric improves the bond of the insole 22 to the outsole 20 formed by the adhesive.

Figure 8A:
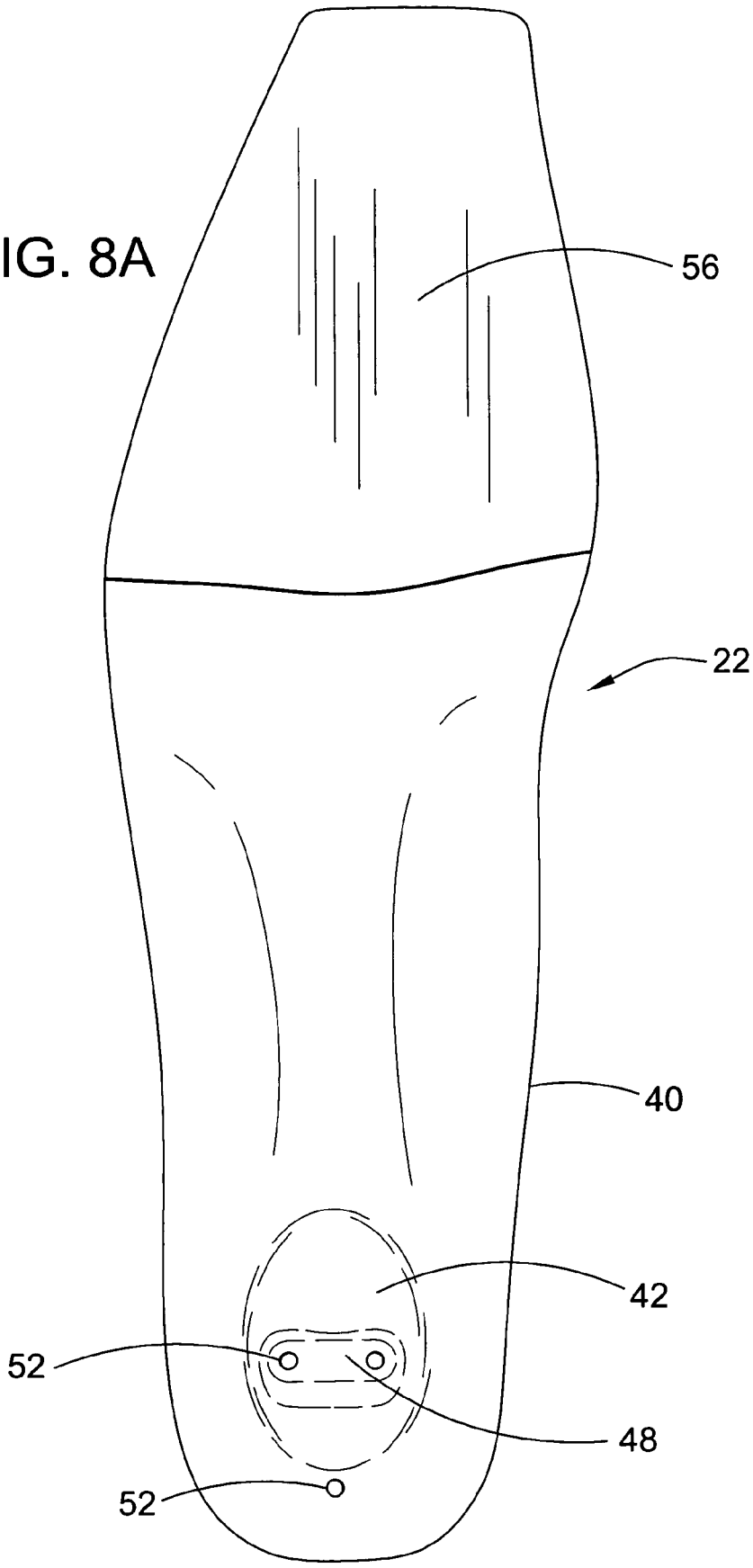
FIG. 8A is a top plan view of an insole of the pump.

A rearward portion 40 (broadly, "rigid heel portion") of the insole 22, which underlies the tarsus of the foot, is stiff (FIG. 2). The stiffness of the rearward portion 40 provides structural rigidity for the pump 10 without the use of a reinforcing (usually metal) shank. However, constructions using a reinforcing shank or other reinforcing structure are contemplated within the scope of the present invention. The rearward portion 40 is formed with a cup 42 sized and shaped for receiving a heel pad 44 located in the heel portion of the insole cushion 24 (broadly, "a footbed"). A trough 48 extends downward from the cup 42 for engaging a slot 50 in the heel 26, and also extends rearwardly. In addition, the rearward portion 40 of the insole 22 contains recesses 52 on its upper surface for receiving (along with trough 48) fasteners, such as screws 54, for fastening the insole to the heel 26 (FIG. 8). The trough 48 defines relatively flat locations for the heads of the screws 54 to rest against. In the illustrated embodiment, three screws 54 are shown, it being understood that any suitable number of screws or other fasteners could be used. A flexible forepart 56, as illustrated in FIG. 2, is adhesively bonded to the stiff rearward portion 40 of the insole 22 at a forward edge of the rearward portion. A cushion (not shown) may be formed within the forepart 56 and is sized and shaped for underlying and cushioning the metatarsal heads during use. The cushion may be made of the same or a different material than the forepart 56. In one embodiment, the entire insole is formed from polyurethane, having different densities in different regions of the insole to produce the desired characteristics (e.g., stiffness, flexibility, cushioning).

Figure 8B:
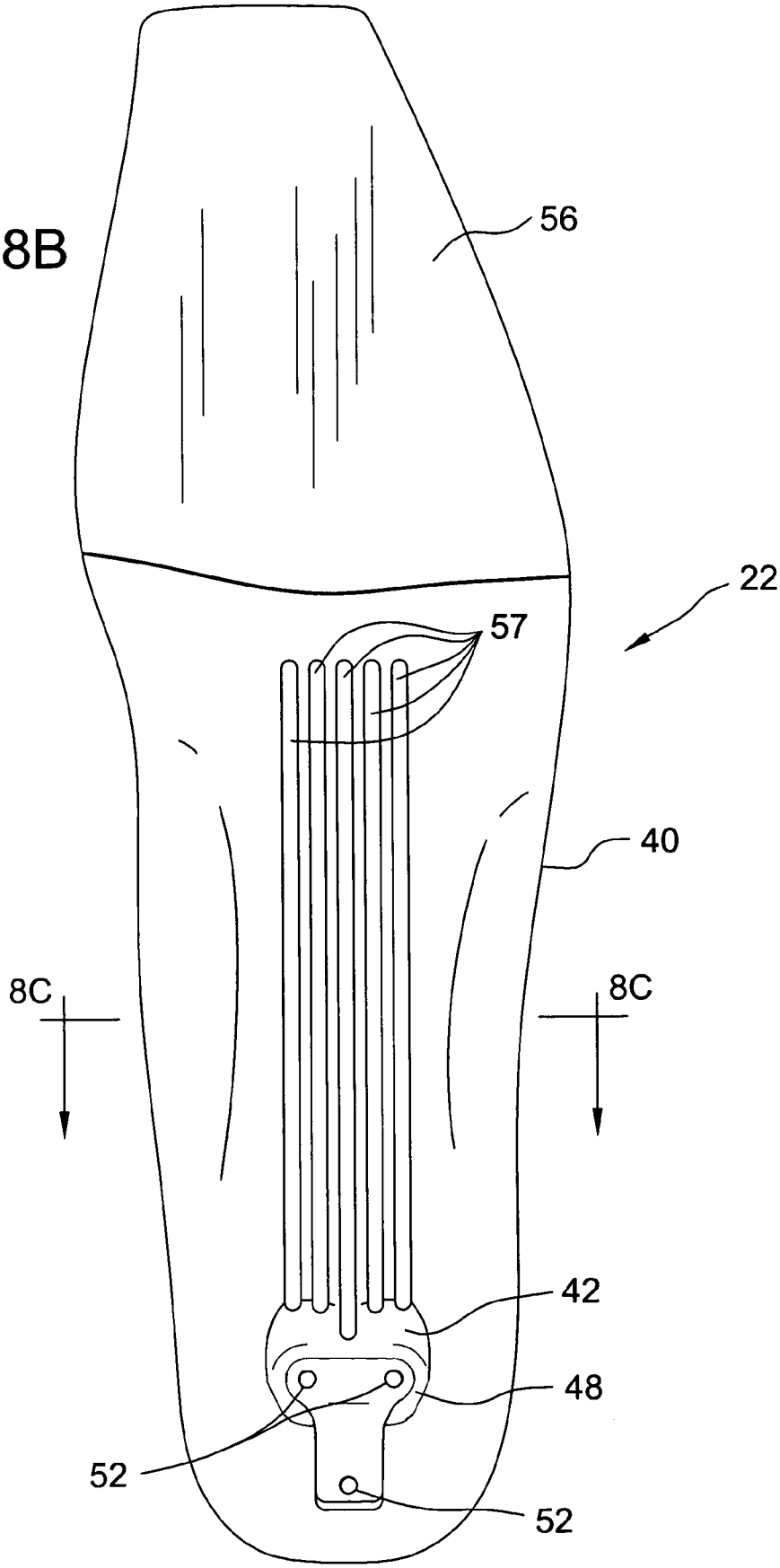
FIG. 8B is a bottom plan view of the insole.
Figure 8C:
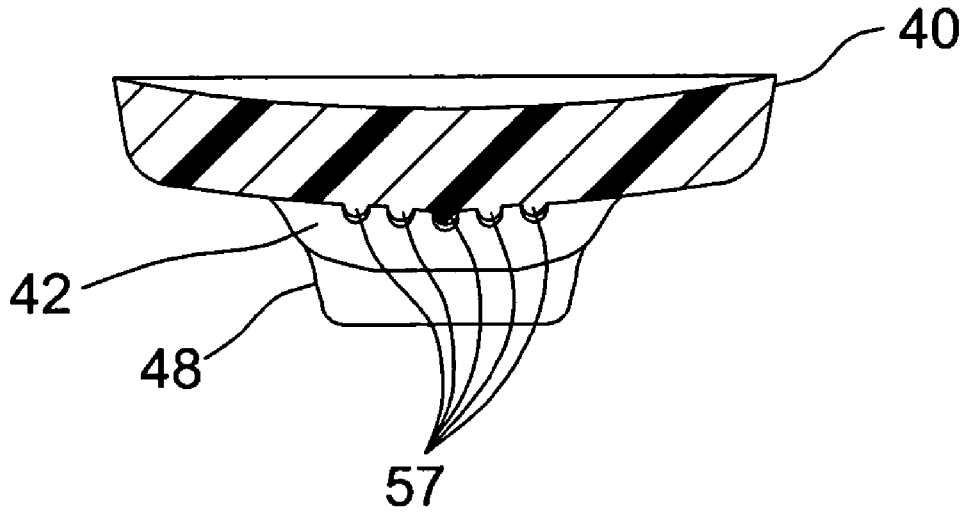
FIG. 8C is a section taken in the plane including line 8C—8C of FIG. 8B.

Thus formed, the insole 22 includes the rearward portion 40 sized and shaped for underlying the tarsus of the foot and a forepart 56. The rearward portion 40 has a flexure stiffness which is sufficiently great to prevent substantial flexure of the rearward portion during use. The rearward portion 40 supports the tarsus of the foot and the arch of the foot during each step. To provide even further stiffness in the instep region of the insole 22, the rearward portion 40 is formed with five spaced-apart ribs 57 (broadly, "reinforcing structure") extending lengthwise of the insole 22 (FIG. 8B). It will be understood that the number of ribs and their exact arrangement may be other than described without departing from the scope of the present invention. As may be seen in FIG. 8C, the ribs 57 are locations of increased thickness of the material of the rearward portion. In other words, the ribs 57 are formed as one piece with the rearward portion 40. The ribs 57 further rigidify the instep of the rearward portion 40 so that a separate shank is not required in the instep. The insole 22 can thus be made entirely from nonmetallic materials and still be strong enough to support the foot at the instep.

The flexure stiffness of the forepart 56, which underlies the metatarsal heads and phalanges of the foot of the wearer, is less than the flexure stiffness of the rearward portion 40. Thus, the forepart 56 permits the foot to roll upward onto the metatarsal heads and the phalanges to flex downward during the toe-off stage of the gait cycle. The forepart 56 is compressively resilient to cushion the metatarsal heads of the foot during the various stages of the gait cycle.

Figure 9:
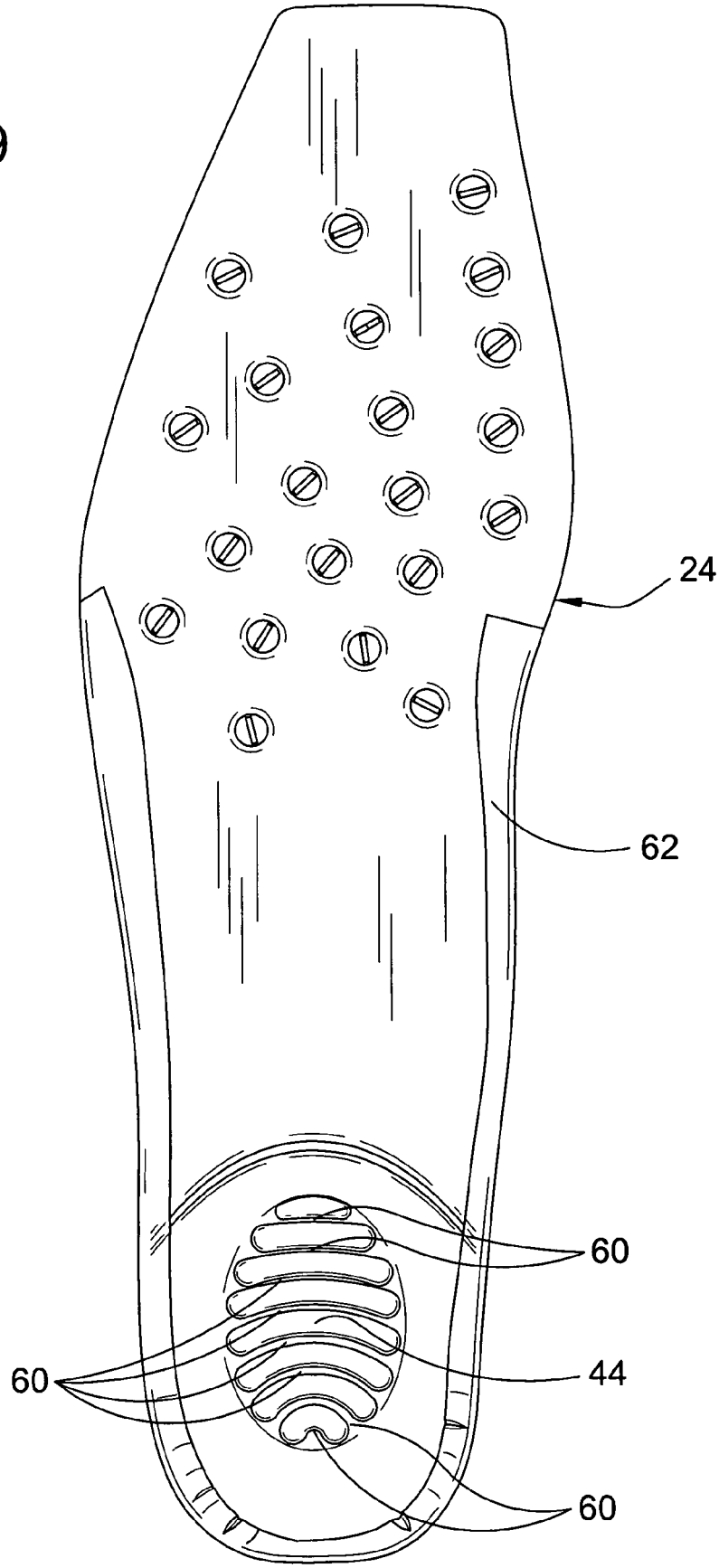
FIG. 9 is a bottom plan view of an insole cushion of the pump.
Figure 10:
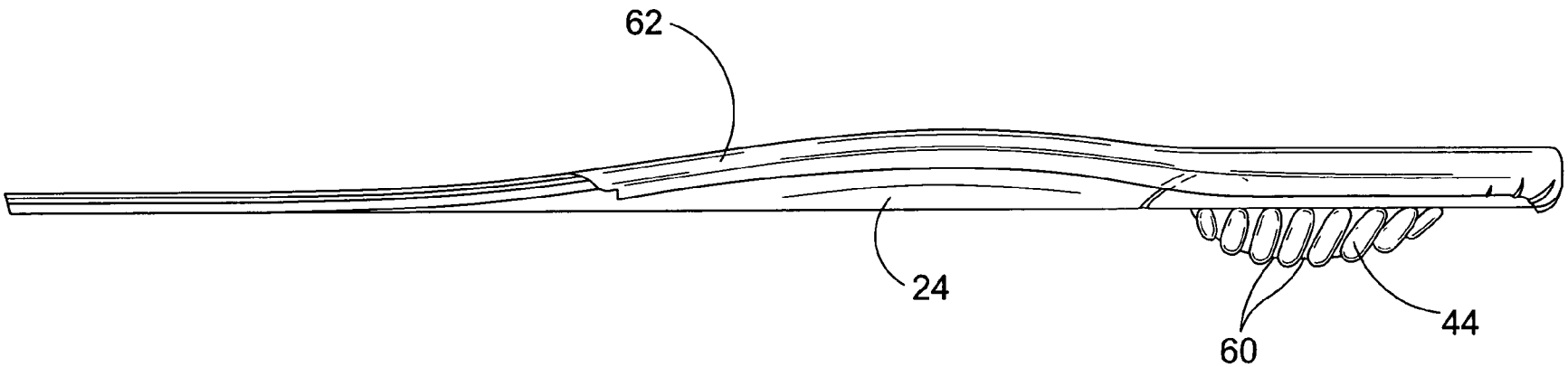
FIG. 10 is a side elevation of the insole cushion.

The insole cushion 24 is adhesively bonded to the insole 22 and is sized and shaped for underlying the foot of the wearer. The insole cushion 24 includes the heal pad 44 located at the heel portion of its bottom surface (FIGS. 9 and 10). The heel pad 44 has relief channels 60 that provide voids into which the material adjacent the relief channels can deform when a load is applied. Although the heel pad 44 may be made of other materials without departing from the scope of the present invention, the insole cushion of the illustrated embodiment is made of a viscoelastic polyurethane formulated to retain resilience during extended use. As illustrated in FIGS. 9 and 10, a sockliner 62 overlies and is adhesively bonded to the insole cushion 24 to finish the inside of the pump 10. The sockliner 62 is made of a suitable material such as calfskin leather, synthetic material or fabric to provide softness and absorbency. Although the construction of the insole and insole cushion of one embodiment is described above, it is envisioned that the insole and insole cushion may have other constructions without departing from the scope of the present invention.

The heel 26 raises the portion the sole 16 adapted for engaging the heel of the wearer. In the embodiment illustrated in FIGS. 4–7, the heel 26 is elongate and has a bottom 66 and a top 68. The top of the heel 26 is cavity 70 (which includes the slot 50) sized and shaped for receiving the cup 42 and the trough 48 of the insole 22. As a result, the heel pad 44, which is contained in the cup 42, is also received in the cavity 70. The bottom 66 of the heel 26 may have a ground engaging member (not shown) affixed to it. The member may also have a tread to increase traction with the ground. The heel of one embodiment is made of ABS. In addition, a covering (not shown), such as calfskin leather, may be used to cover the heel for aesthetic purposes. The heel may be formed in different configurations or made of other materials without departing from the scope of the present invention.

The heel breast 28 projects forward from the heel 26 and is formed as one piece with the heel. The heel breast 28 has a depression 72 on its upper side. The depression 72 is generally U-shaped in cross section, sized and shaped for receiving a portion of cup 42 extending forward from the cavity 70 in the heel 26. The depression 72 in the heel breast 28 converges with the cavity 70 in the heel 26 to collectively form the recess 30. As a result, the heel pad 44, which is contained in the cup 42, is positioned both in the cavity 70 of the heel 26 and forward the heel in the depression 72 of the heel breast 28. Thus, the heel pad 44 underlies the location on the wearer's foot to which the impact forces are applied and therefore can adequately attenuate the forces. The heel breast may be formed in different configurations or made of various materials without departing from the scope of the present invention.

In use, the heeled footwear of the present invention provides padding to portions of the wearer's heel to which impact forces are transferred from the heel of the footwear. As mentioned above, during the gait cycle, the heel strikes the ground first, and then the foot pivots on the heel so the forefoot contacts the ground. Impact forces are transferred from the portion of the heel contacting the ground vertically to the wearer's foot. In a heeled shoe, the impact force is transferred to portions of the wearer's heel forward the heel of the footwear. Generally speaking, the higher the heel of the shoe the more forward the location of impact on the wearer's heel. Accordingly, the present invention provides a heel breast 28 with a depression 72 for receiving at least a portion of the heel pad 44. As a result, even if the impact force is transferred to a portion of the wearer's foot forward the heel of the footwear padding is provided between the sole and the wearer's heel to attenuate the impact forces thereby reducing the stress on the wearer's body and providing the wearer a more comfortable shoe. The size and location of the heel breast and heel pad received therein can be adjusted for the particular height of the shoe heel.

As will apparent to those skilled in the art, the pump 10 of the present invention may be assembled using various conventional and well-known methods.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. Footwear comprising:

an outsole;

a heel having a distal end and a centerline passing through the distal end;

an insole;

a heel pad;

a heel breast projecting forward from the heel;

the heel breast being sized and shaped for receiving a majority of the heel pad forward of the heel centerline.

2. Footwear as set forth in claim 1 wherein the heel breast is sized and shaped for receiving at least three-fourths of the heel pad forward of the heel centerline.

3. Footwear as set forth in claim 1 wherein the heel pad has a volume, the heel breast being sized and shaped for receiving a majority of said volume forward of the heel centerline.

4. Footwear as set forth in claim 1 wherein the heel pad has a length dimension, the heel breast being sized and shaped for receiving a majority of said length dimension forward of the heel centerline.

5. Footwear as set forth in claim 1 wherein the heel includes a substantially planar bottom surface at its distal end and a forward edge, a majority of the heel pad being located forward of a plane oriented perpendicular to the bottom surface and containing said forward edge.

6. A shoe comprising:

an upper shaped to define a volume for receiving a foot therein and having an opening for passage of the foot into the volume; and a sole comprising, an outsole, a heel, an insole, a heel pad, a heel breast projecting forward from the heel, the heel breast being sized and shaped for receiving at least a portion of the heel pad.

7. A shoe as set forth in claim 6 wherein the heel breast is formed with a depression for receiving said heel pad portion.

8. A shoe as set forth in claim 7 wherein the depression in the heel breast is generally U-shaped in cross section.

9. A shoe as set forth in claim 8 wherein the heel includes a cavity sized and shaped for receiving a portion of the heel pad.

10. A shoe as set forth in claim 9 wherein the depression in the heel breast converges with the cavity in the heel.

11. A shoe as set forth in claim 6 further comprising an insole cushion sized and shaped for underlying the foot, the heel pad being attached to the insole cushion.

12. A shoe as set forth in claim 11 wherein the insole includes a cup sized and shaped for being received in the cavity of the heel, and the insole cushion comprises the heel pad sized and shaped for being received in the cup of the insole.

13. A shoe as set forth in claim 6 further comprising a sockliner overlying the insole cushion.

14. A shoe as set forth in claim 6 wherein the heel breast intersects the heel above a bottom of the heel.

15. A shoe as set forth in claim 14 wherein the heel breast includes a bottom surface forming an angle with the heel.

16. A shoe as set forth in claim 6 wherein the insole comprises a rigid heel portion having at least one reinforcing rib extending through an instep region of the rigid heel portion.

17. A shoe comprising:

an upper shaped to define a volume for receiving a foot therein and having an opening for passage of the foot into the volume; and a sole comprising, an outsole, a heel, an insole including a rigid heel portion sized and shaped for underlying the heel and instep of a wearer of the shoe, the rigid heel portion having reinforcing structure formed as one piece with the heel portion, the reinforcing structure comprising at least one rib.

18. A shoe as set forth in claim 17 wherein the insole includes plural ribs extending generally lengthwise of the insole and spaced apart laterally of the insole.

19. A shoe as set forth in claim 17 wherein the ribs are located generally in a region corresponding to the instep of the wearer.

20. A shoe as set forth in claim 17 wherein the insole, heel portion, and at least one rib are formed from nonmetallic material.

* * * * *